United States Patent [19]

Hinrichsen et al.

[11] 4,012,240

[45] Mar. 15, 1977

[54] Cu-Ni-Sn ALLOY PROCESSING

[75] Inventors: Robert Alfred Hinrichsen, Basking Ridge; John Travis Plewes, Berkeley Heights, both of N.J.

[73] Assignee: Bell Telephone Laboratories, Incorporated, Murray Hill, N.J.

[22] Filed: Oct. 8, 1975

[21] Appl. No.: 620,644

[52] U.S. Cl. ..... 148/11.5 C; 148/12.7 C
[51] Int. Cl.[2] ..... C22F 1/08
[58] Field of Search ..... 148/11.5 C, 12.7 C; 75/154, 159

[56] References Cited

UNITED STATES PATENTS

| | | | |
|---|---|---|---|
| 1,545,838 | 7/1925 | Lehr | 75/154 |
| 1,816,509 | 7/1931 | Wise | 75/154 |
| 2,117,106 | 5/1938 | Silliman | 75/154 |
| 2,128,122 | 8/1938 | Dahl et al. | 148/12.7 C |
| 3,663,311 | 5/1972 | Chin et al. | 148/11.5 C |
| 3,940,290 | 2/1976 | Pryor et al. | 148/12.7 C |
| 3,941,620 | 3/1976 | Pryor et al. | 148/12.7 C |

OTHER PUBLICATIONS

Plewes, J. T.; Metal Progress; Spinodal Cu-Ni-Sn Alloys are Strong and Superductile; July 1974; pp. 46–48.
Schwartz, L. H. et al. Acta Metalurgica; Decomposition of Copper–Nickel–Tin and its effect on Mechanical Properties; 5/1974; pp. 601–609.
Backofen, W. A.; Deformation Processing; 1972; Addison–Wesley Publishing Co.

*Primary Examiner*—W. Stallard
*Attorney, Agent, or Firm*—Peter V. D. Wilde

[57] ABSTRACT

A method is disclosed for processing a coppernickel-tin ingot of a composition which at room temperature is in a two-phase state and which at a temperature significantly higher than room temperature but below the melting temperature of the alloy is in a single-phase state. The disclosed method calls for mechanical deformation of the cast ingot in a two-phase state by an amount corresponding to at least 30 percent area reduction and at a temperature above the reversion temperature and near the recrystallization temperature of the alloy. The deformed ingot may subsequently undergo further processing steps such as homogenizing, cold working, and aging.

6 Claims, 1 Drawing Figure

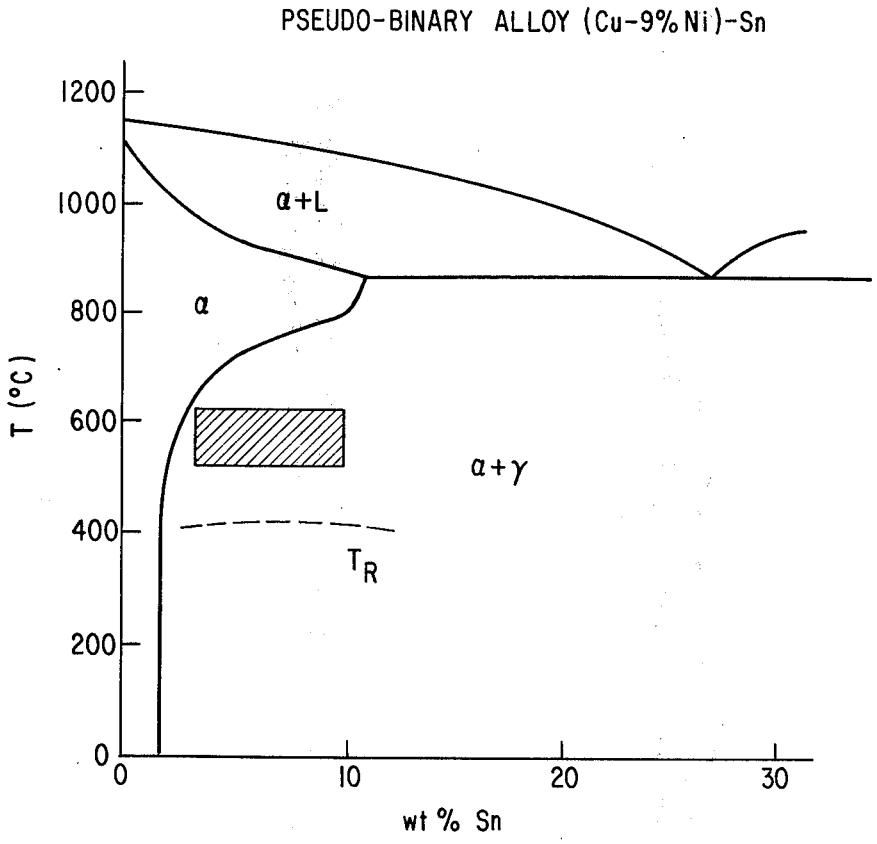
PSEUDO-BINARY ALLOY (Cu-9% Ni)-Sn
1200
1000
800
600
400
200
0
T (°C)
α+L
α
α+γ
$T_R$
0
10
20
30
wt % Sn

CU-NI-SN ALLOY PROCESSING

FIELD OF THE INVENTION

The invention is concerned with the processing of copper-nickel-tin alloys.

BACKGROUND OF THE INVENTION

Advances in processing copper-nickel-tin alloys have led to interest in these alloys for applications where electrical conductivity, corrosion resistance, mechanical strength and mechanical ductility are of concern. In the field of communications, for example, such applications include the manufacture of electrical wire, springs, and relay elements, applications in which copper-nickel-tin alloys can beneficially replace the traditionally used copper-beryllium and phosphor-bronze alloys. Copper-nickel-tin alloys are also potentially applicable in shipbuilding and in sea water desalination plants.

Achievement of high levels of strength and ductility in copper-nickel-tin alloys is largely dependent on cold working and heat treating homogenized alloys. Such processing is a subject of "Spinodal Cu-Ni-Sn Alloys Are Strong and Superductile" by John T. Plewes published in Metal Progress, July 1974, pages 46–48, where amounts of cold work in combination with aging times and temperatures are disclosed which lead to high degrees of strength and ductility in the processed alloy.

The preparation of a homogenized Cu-Ni-Sn ingot can be accomplished by normal practice such as hot working provided the thickness of the ingot as cast does not significantly exceed one inch and provided further that neither its tin nor its nickel contents significantly exceed 4.5 percent. Attempts at applying hot working to thicker ingots or ingots richer in tin or nickel lead to undesirable effects such as surface cracking, edge cracking, and alligatoring. The latter, described in general terms in "Deformation Processing" by Walter A. Backofen, Adison Wesley, 1972, consists in deep horizontal splitting of the end of the slab upon delivery from the rolling mill.

SUMMARY OF THE INVENTION

The invention is a method for processing a copper-nickel-tin cast ingot of a composition which at room temperature is in a two-phase state and which at a temperature significantly higher than room temperature but below the melting temperature of the alloy is in a single phase state. The claimed method comprises heating the cast ingot to a temperature near the recrystallization temperature and above the reversion temperature of the alloy and working the ingot by an amount of at least 30 percent area reduction.

BRIEF DESCRIPTION OF THE DRAWING

The FIGURE is the equilibrium phase diagram of the (Cu-9% Ni)-Sn alloy.

DETAILED DESCRIPTION

The FIGURE shows phases $\alpha$ and $\alpha+\gamma$ for the Cu-Ni-Sn alloy containing nine percent Ni, a varying amount of Sn, and remainder Cu. Phase boundaries are shown as solid lines; a dashed line connects points corresponding to the reversion temperature. Points in the shaded area of the diagram correspond to combinations of tin concentrations and temperatures at which the claimed method is carried out.

The Method

The method applies to Cu-Ni-Sn ingots of an alloy which at room temperature is in a two-phase state and which at a temperature significantly higher than room temperature and below the melting point of the alloy is in a single-phase state. Preferably, the alloy contains from 3–30 percent nickel and from 3–10 percent tin, remainder copper; tin contents exceeding four percent are of particular commercial importance. The method calls for deforming the ingot in a two-phase state by an amount corresponding to at least 30 percent area reduction at a temperature in a preferred temperature range related to the recrystallization temperature of the alloy and its reversion temperature as defined below.

The recrystallization temperature of the alloy is defined as the lowest temperature at which a heavily deformed grain structure is completely replaced by a deformation-free grain structure in a matter of at most a few hours. In the context of the claim method the recrystallization temperature is a preferred temperature at which the ingot is to be deformed. The reversion temperature mentioned above can be defined as that temperature below which deformation causes age hardening of the alloy and above which a deformed alloy remains relatively soft.

For an alternate definition in terms of electrical resistivity of the alloy see L. H. Schwartz, S. Mahajan, and J. T. Plewes, "Decomposition of Copper-Nickel-Tin Super-saturated Solid Solution and its Effects on Mechanical Properties" Acta Metallurgica, Vol. 22, (1974), pages 601–609. The reversion temperature typically lies below the recrystallization temperature and, in the interest of softness in the worked ingot, represents a lower limit for the temperature at which the claimed method is carried out. The preferred upper limit for the temperature of the claimed method is chosen to prevent formation of a singlephase alloy; typically, the preferred upper limit exceeds the recrystallization temperature by 100° C.

The work called for may be performed by any suitable means such as rolling or forging, and is required to amount to at least 30 percent reduction in area to effect a completely homogeneous subsequent recrystallization in the cast structure.

For a fixed tin content the recrystallization temperature increases by about 100° C as nickel contents increase from 3–30 percent. Accordingly, ranges of from 500° to 600° C at three percent nickel and of from 600° C to 700° C at 30 percent nickel are preferred for the claimed process, with temperature ranges to be chosen linearly scaled for intermediate levels of Ni.

The preferred method is applicable to cast ingots of a thickness up to at least three inches. It is of particular practical significance for cast ingots of a thickness exceeding one inch and of particular commercial importance for castings of a thickness greater than about two inches.

The method was found to be applicable to alloys containing elements other than Cu, Ni, Sn at levels commonly present in commercially available mateials. Specifically, impurities at levels up to the following limits have no serious detrimental effect: 0.5 percent Fe, 0.5 percent Co, 0.5 percent Zn, 0.1 percent Al, 0.5 percent Mn, 0.1 percent Ti, 0.1 percent Mg, 0.1 percent Cr, 0.1 percent Nb, 0.1 percent In. Less commonly encountered impurities were also found to be harmless when present in concentrations not exceeding the following limits:

0.05 percent Li, 0.05 percent Sb, 0.01 percent P, 0.05 percent Si, 0.005 percent Pb, 0.01 percent Y, 0.1 percent Ge.

EXAMPLE I

A 2.0 inch thick cast ingot of nine percent Ni, 6 percent Sn, remainder copper was heated to a temperature of 550° C and rolled by an amount of 50 percent area reduction. A smooth-surface slab was obtained which, upon microscopic inspection, revealed a fine, uniform, two-phase structure.

EXAMPLE 2

A 1.5 inch thick cast ingot of 25 percent Ni, 8 percent Sn, remainder copper was heated to a temperature of 650° C and rolled by an amount of 75 percent area reduction. A highly ductile, smooth-surfaced two-phase slab was obtained.

The claimed method was also applied successfully at 600° C to an ingot containing twelve percent Ni and 8 percent Sn, and at 550° C to an ingot containing 8 percent Ni and eight percent Sn.

What is claimed is:

1. A method for processing a cast Cu-Ni-Sn ingot consisting essentially of an alloy having a composition of from 3–30% nickel, from 3–10% tin, and remainder copper and which at room temperature is in a two-phase state and which at a temperature significantly higher than room temperature and slightly below the melting temperature of said alloy is in a single-phase state, CHARACTERIZED IN THAT said ingot is worked by an amount corresponding to at least 30 percent area reduction at a temperature at which said alloy is in a two-phase state and which lies above the reversion temperature of said alloy and near the recrystallization temperature of said alloy.

2. Method of claim 1 in which said ingot contains at least four percent tin.

3. Method of claim 1 in which said temperature is in the range of from 500° to 600° C at three percent nickel, in the range of from 600° to 700° C at 30 percent nickel, and in linearly scaled temperature ranges at intermediary levels of nickel.

4. Method of claim 1 in which said cast ingot has a thickness in the range of from 1 to 3 inches.

5. Method of claim 4 in which said cast ingot has a thickness in the range of from 2 to 3 inches.

6. Method of claim 1 in which said alloy contains impurities in amounts not exceeding the following limits: 0.5 percent Fe, 0.5 percent Co, 0.5 percent Zn, 0.1 percent Al, 0.5 percent Mn, 0.1 percent Ti, 0.1 percent Mg, 0.1 percent Cr, 0.1 percent Nb, 0.1 percent In, 0.05 percent Li, 0.05 percent Sb, 0.01 percent P, 0.05 percent Si, 0.005 percent Pb, 0.01 percent Y, 0.1 percent Ge.

* * * * *